US010037686B1

(12) United States Patent
Magyar et al.

(10) Patent No.: US 10,037,686 B1
(45) Date of Patent: Jul. 31, 2018

(54) SYSTEMS AND METHODS FOR PREVENTING FALSE ALARMS DURING ALARM SENSITIVITY THRESHOLD CHANGES IN FIRE ALARM SYSTEMS

(71) Applicant: Honeywell International Inc., Morristown, NJ (US)

(72) Inventors: George John Magyar, Wallingford, CT (US); George P. Mancini, Wallingford, CT (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days.

(21) Appl. No.: 15/627,864

(22) Filed: Jun. 20, 2017

(51) Int. Cl.
*G08B 29/26* (2006.01)
*G08B 17/06* (2006.01)

(52) U.S. Cl.
CPC ..... *G08B 29/26* (2013.01); *G08B 17/06* (2013.01)

(58) Field of Classification Search
CPC ..... G08B 29/26; G08B 29/185; G08B 17/06
See application file for complete search history.

(56) References Cited

U.S. PATENT DOCUMENTS

| | | | |
|---|---|---|---|
| 5,155,468 | A | 10/1992 | Stanley et al. |
| 5,552,763 | A | 9/1996 | Kirby |
| 5,786,756 | A | 7/1998 | Piller |
| 7,642,924 | B2 | 1/2010 | Andres et al. |

FOREIGN PATENT DOCUMENTS

JP 10-63965 A 3/1998

OTHER PUBLICATIONS

English language translation of abstract, description, claims, and bibliographic information for Japanese Patent No. JPH1063965 (A).

*Primary Examiner* — Brian Zimmerman
*Assistant Examiner* — Sara Samson
(74) *Attorney, Agent, or Firm* — Husch Blackwell LLP

(57) ABSTRACT

Systems and methods are provided for preventing false alarms during alarm sensitivity threshold changes in fire alarm systems. Some methods can include determining a current state of a connected system, determining a current alarm sensitivity threshold of the connected system, determining a future alarm sensitivity threshold of the connected system, and identifying a future false alarm when the current state would trigger an actual alarm under the future alarm sensitivity threshold but fails to trigger the actual alarm under the current alarm sensitivity threshold. Responsive to identifying the future false alarm, some methods can include executing a first action to prevent the future false alarm from occurring.

20 Claims, 2 Drawing Sheets

SYSTEMS AND METHODS FOR PREVENTING FALSE ALARMS DURING ALARM SENSITIVITY THRESHOLD CHANGES IN FIRE ALARM SYSTEMS

FIELD

The present invention relates generally to fire alarm systems. More particularly, the present invention relates to systems and methods for preventing false alarms during alarms sensitivity threshold changes in fire alarm systems.

BACKGROUND

When a fire alarm system changes an alarm sensitivity threshold of the fire alarm system or a device that is part of the fire alarm system, the fire alarm system or the device can be vulnerable to false alarms or nuisance alarms, for example, when a new alarm sensitivity threshold is more sensitive than a current alarm sensitivity threshold.

In view of the above, there is a continuing, ongoing need for improved systems and methods.

DETAILED DESCRIPTION

Figure 1:
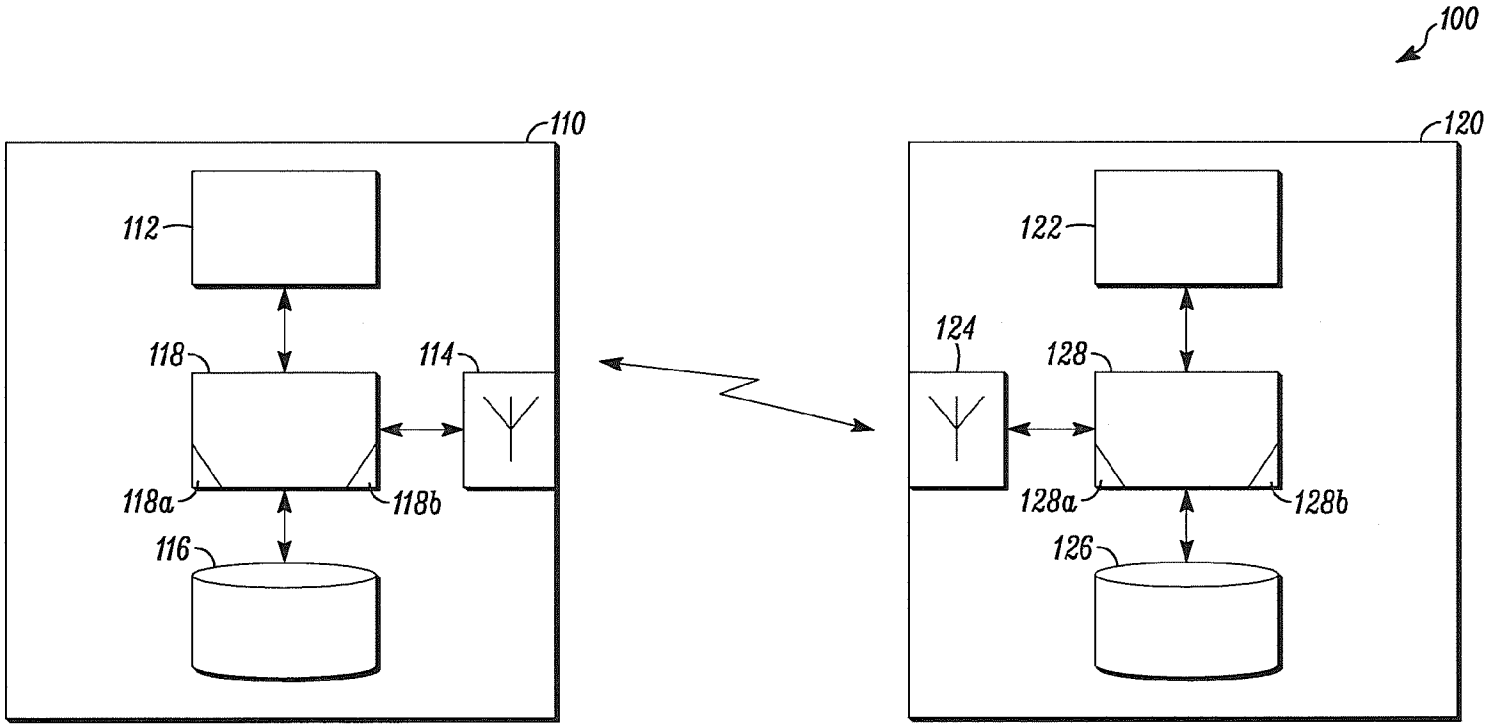
FIG. 1 is a block diagram of a system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods for preventing false alarms during alarm sensitivity threshold changes in fire alarm systems. For example, in some embodiments, systems and methods disclosed herein can compare a current alarm sensitivity threshold of a fire alarm system or a device that is part of the fire alarm system to a different, future alarm sensitivity threshold and, responsive thereto, determine whether a current state of the fire alarm system or the device that is part of the fire alarm system would trigger an alarm under the future alarm sensitivity threshold even though the current state does not trigger the alarm under the current alarm sensitivity threshold. Such an alarm can be identified as a future false alarm, and systems and methods disclosed herein can assist in preventing such future false alarms.

For example, in some embodiments, when systems and methods disclosed herein identify the future false alarm, systems and methods disclosed herein can provide an audible or visual warning to a user at a predetermined period of time prior to the future false alarm to prompt the user to take action to prevent the future false alarm from occurring. In some embodiments, systems and methods disclosed herein can provide the audible or visual warning at the predetermined period of time prior changing to the future alarm sensitivity threshold. Furthermore, in some embodiments, user action to prevent the future false alarm from occurring can include changing the current state of the fire alarm system or the device that is part of the fire alarm system, changing the future alarm sensitivity threshold, or disabling the fire alarm system or the device that is part of the fire alarm system.

Additionally or alternatively, in some embodiments, when systems and methods disclosed herein identify the future false alarm, systems and methods disclosed herein can trigger a state change, such as a trouble event or a non-alarm event, and communicate the state change to the user or to devices in the fire alarm system. In some embodiments, the state change can be local to a fire alarm control panel, and in some embodiments, the state change can be made in some or all of the devices that are part of the fire alarm system. Furthermore, in some embodiments, the state change can be communicated to the user and/or to some or all of the devices that are part of the fire alarm system via one or more of a fire alarm network, a central station, an IP connection, and any other communication system or network as would be understood by one of ordinary skill in the art.

Systems and methods disclosed herein are described in connection with fire alarm systems. However, it is to be understood that systems and methods disclosed herein are not so limited and could be used in connection with a security system or any connected home system with internet of things (IoT) devices.

Figure 2:
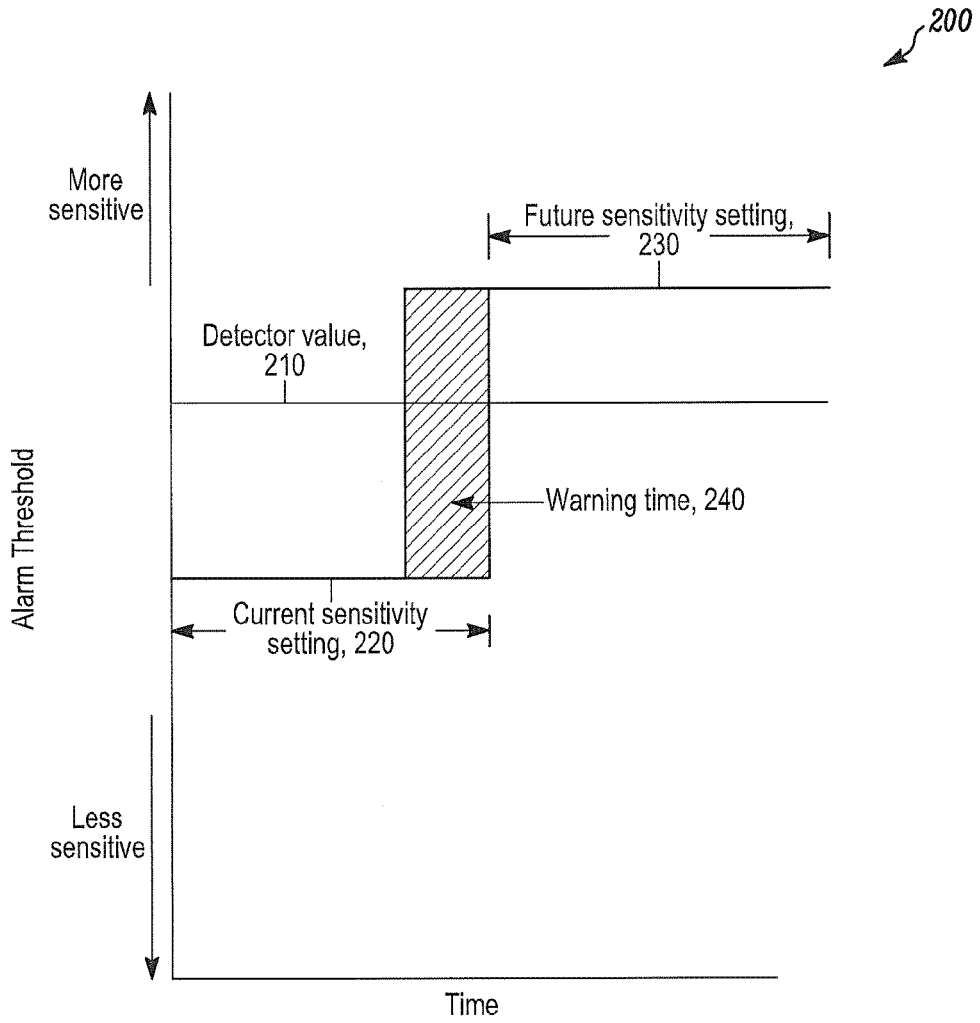
FIG. 2 is a graph illustrating principles of disclosed embodiments.

FIG. 1 is a block diagram of a system 100 in accordance with disclosed embodiments, and FIG. 2 is a graph 200 illustrating principles of disclosed embodiments. As seen in FIG. 1, the system 100 can include a fire alarm control panel device 110 in communication with a fire alarm detector 120. The fire alarm control panel device 110 can identify a current state of the system 100, the fire alarm control panel device 110, or the fire alarm detector 120, for example, a detector value 210 in FIG. 2. The fire alarm control panel device 110 can also identify a current alarm sensitivity threshold of the system 100, the fire alarm control panel device 110, or the fire alarm detector 120, for example, a current sensitivity setting 220 in FIG. 2. The fire alarm control panel device 110 can also identify a future alarm sensitivity threshold of the system 100, the fire alarm control panel device 110, or the fire alarm detector 120, for example, a future sensitivity setting 230 in FIG. 2. The fire alarm control panel device 110 can also determine whether the current state 210 would trigger an alarm under the future alarm sensitivity threshold 230 even though the current state 210 does not trigger the alarm under the current alarm sensitivity threshold 220 and identify such an alarm as a future false alarm.

Responsive to identifying the future false alarm, the fire alarm control panel device 110 can provide an audible or visual warning to a user at a predetermined period of time prior changing to the future alarm sensitivity threshold, for example, during a warning time 240 in FIG. 2, to solicit action from the user. Additionally or alternatively, responsive to identifying the future false alarm, the fire alarm control panel device 110 can trigger a state change in the system 100, the fire alarm control panel device 110, or the fire alarm detector 120 and can communicate the state change to the user, the system 100, or the fire alarm detector 120.

As seen in FIG. 1, each of the fire alarm control panel device 110 and the fire alarm detector 120 can include a respective user interface device 112, 122, a respective transceiver device 114, 124, and a respective memory device 116, 126, each of which can be in communication with respective control circuitry 118, 128, a respective programmable processor(s) 118*a*, 128*a*, and respective executable control software 118*b*, 128*b* as would be understood by one of ordinary skill in the art. The executable control software

118*b*, 128*b* can be stored on a transitory or non-transitory computer readable medium, including but not limited to local computer memory, RAM, optical storage media, magnetic storage media, flash memory, and the like.

In some embodiments, some or all of the control circuitry 118, 128, the programmable processors 118*a*, 128*a*, and the executable control software 118*b*, 128*b* can execute and control the methods described herein. For example, the control circuitry 118, 128, the programmable processors 118*a*, 128*a*, and the executable control software 118*b*, 128*b* can identify the current state 210, the current alarm sensitivity threshold 220, and the future alarm sensitivity threshold 230 via user input received via the user interface devices 112, 122, via one or more signals received via the transceiver devices 114, 124, or from some or all of the control circuitry 118, 128, the programmable processors 118*a*, 128*a*, and the executable control software 118*b*, 128*b*. Furthermore, some or all of the control circuitry 118, 128, the programmable processors 118*a*, 128*a*, and the executable control software 118*b*, 128*b* can identify the future false alarm by determining whether the current state 210 would trigger the alarm under the future alarm sensitivity threshold 230 even though the current state 210 does not trigger the alarm under the current alarm sensitivity threshold 220. Further still, responsive to identifying the future false alarm, some or all of the control circuitry 118, 128, the programmable processors 118*a*, 128*a*, and the executable control software 118*b*, 128*b* can provide the audible or visual warning via the user interface devices 112, 122 or can trigger the state change in some or all of the control circuitry 118, 128, the programmable processors 118*a*, 128*a*, and the executable control software 118*b*, 128*b*.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

control circuitry determining a current state of a connected system;

the control circuitry determining a current alarm sensitivity threshold of the connected system;

the control circuitry determining a future alarm sensitivity threshold of the connected system;

the control circuitry identifying a future false alarm when the current state would trigger an actual alarm under the future alarm sensitivity threshold but fails to trigger the actual alarm under the current alarm sensitivity threshold; and responsive to identifying the future false alarm, the control circuitry executing a first action to prevent the future false alarm from occurring.

2. The method of claim 1 wherein the connected system is a fire alarm system, is a security system, or includes a plurality of IoT devices.

3. The method of claim 1 wherein determining the current state of the connected system includes determining the current state of a device in the connected system, and wherein the device includes a control panel or a detector.

4. The method of claim 1 wherein executing the first action includes instructing a user interface device to emit an audible or visual warning signal.

5. The method of claim 4 wherein the audible or visual warning signal solicits a second action from a user.

6. The method of claim 5 wherein the second action includes changing the current state, changing the future alarm sensitivity threshold, or disabling the connected system or a device in the connected system.

7. The method of claim 1 further comprising the control circuitry executing the first action at a predetermined period of time prior to the future false alarm occurring.

8. The method of claim 1 further comprising the control circuitry executing the first action at a predetermined period of time prior to changing to the future alarm sensitivity threshold.

9. The method of claim 1 wherein executing the first action includes triggering a state change in the connected system or a device in the connected system.

10. The method of claim 9 wherein the state change includes a trouble event or a non-alarm event.

11. A control panel device of a connected system comprising:

a transceiver device in communication with a system device;

a programmable processor; and executable control software stored on a non-transitory computer readable medium, wherein the programmable processor and the executable control software determine a current state of the connected system, the control panel device, or the system device, wherein the programmable processor and the executable control software determine a current alarm sensitivity threshold of the connected system, the control panel device, or the system device, wherein the programmable processor and the executable control software determine a future alarm sensitivity threshold of the connected system, the control panel device, or the system device, wherein the programmable processor and the executable control software identify a future false alarm when the current state would trigger an actual alarm under the future alarm sensitivity threshold but fails to trigger the actual alarm under the current alarm sensitivity threshold, and wherein, responsive to identifying the future false alarm, the programmable processor and the executable control software execute a first action to prevent the future false alarm from occurring.

12. The control panel device of claim 11 wherein the connected system is a fire alarm system or a security system, or wherein the system device includes an IoT device.

13. The control panel device of claim 11 wherein the programmable processor and the executable control software identify the current state via a signal received via the transceiver device or via user input received via a user interface device.

14. The control panel device of claim 11 further comprising a user interface device, wherein the programmable processor and the executable control software execute the first action by instructing the user interface device to emit an audible or visual warning signal.

15. The control panel device of claim 14 wherein the audible or visual warning signal solicits a second action from a user.

16. The control panel device of claim 15 wherein the second action includes changing the current state, changing the future alarm sensitivity threshold, or disabling the connected system, the control panel device, or the system device.

17. The control panel device of claim 11 wherein the programmable processor and the executable control software execute the first action at a predetermined period of time prior to the future false alarm occurring.

18. The control panel device of claim 11 wherein the programmable processor and the executable control software execute the first action at a predetermined period of time prior to changing to the future alarm sensitivity threshold.

19. The control panel device of claim 11 wherein the programmable processor and the executable control software execute the first action by triggering a state change in the connected system, the control panel device, or the system device.

20. The control panel device of claim 19 wherein the state change includes a trouble event or a non-alarm event.

* * * * *